United States Patent [19]

Knoblauch et al.

[11] 4,204,972

[45] May 27, 1980

[54] HYDRAULIC FLUIDS COMPRISING NITROGEN-CONTAINING BORIC ACID ESTERS

[75] Inventors: Wolfgang Knoblauch, Burghausen; Konrad von Werner, Burgkirchen, both of Fed. Rep. of Germany

[73] Assignees: Hoechst Aktiengesellschaft; Alfred Teves, both of Frankfurt am Main, Fed. Rep. of Germany

[21] Appl. No.: 7,723

[22] Filed: Jan. 30, 1979

[30] Foreign Application Priority Data

Feb. 3, 1978 [DE] Fed. Rep. of Germany ..... 2804535

[51] Int. Cl.[2] ..... C10M 3/48; C10M 3/26

[52] U.S. Cl. ..... 252/78.1; 260/462 R

[58] Field of Search ..... 252/77, 78.1; 260/462 R

[56] References Cited

U.S. PATENT DOCUMENTS

| | | | |
|---|---|---|---|
| 3,729,497 | 4/1973 | Sawyer et al. | 260/462 R |
| 3,972,822 | 8/1976 | Sato et al. | 252/78.1 |
| 4,088,590 | 5/1978 | Knoblauch et al. | 252/73 |

FOREIGN PATENT DOCUMENTS

| | | |
|---|---|---|
| 2438038 | 2/1975 | Fed. Rep. of Germany . |
| 768226 | 2/1957 | United Kingdom . |

*Primary Examiner*—Harris A. Pitlick

*Attorney, Agent, or Firm*—Connolly and Hutz

[57] ABSTRACT

Hydraulic fluids the primary properties of which comply with the official specifications and, moreover, which have a good lubricating effect, a high oxidation stability and a high acid stability consist of about 10 to 60% by weight of a nitrogen-containing boric acid ester, about 5 to 30% by weight of an alkyl-polyethylene glycol tert. butyl ether and about 35 to 75% by weight of a glycol monoalkyl ether. The nitrogen-containing boric acid ester is a reaction product of an alkoxylated monoalkyl amine, orthoboric acid and optionally a glycol.

4 Claims, No Drawings

HYDRAULIC FLUIDS COMPRISING NITROGEN-CONTAINING BORIC ACID ESTERS

This invention relates to hydraulic fluids.

High demands are made on power transmitting or hydraulic fluids, especially brake fluids, as regards their chemical and physical properties. According to the standards existing at present (cf. specifications DOT 3 and DOT 4 of the US Department of Transportation in Federal Motor Vehicle Safety Standard FMVSS no. 116 and Specification SAE J 1703 of the Society of Automotive Engineers, New York) brake fluids should have the following basic properties: a high dry boiling point (reflux boiling point—dry) and wet boiling point (reflux boiling point—wet) and a viscosity which changes little only over a wide temperature range.

Besides these primary properties, a brake fluid should possess a good lubrifying effect, a high oxidation stability as well as a high stability to acids and, hence, an excellent corrosion inhibition behavior. The extremely high mechanical and, in part, also thermal load on hydraulic agents, especially brake fluids, during their use generally results in an acid increase which is obviously due to a chemical decomposition of one or several components of the hydraulic agent. With a high acid increase the hydraulic agent does not only lose its basic properties, especially its viscosity and its high dry boiling point, but also the metals of the hydraulic system coming into contact with said agent are liable to corrosion.

German Pat. Nos. 939,045 and DE-OS 1,768,933; 2,437,936; 2,438,038; 2,457,097; 2,525,403 and 2,532,228 are concerned with brake fluids on the basis of boric acid esters of glycols and/or glycol monoalkyl ethers. German Pat. No. 939,045 and DE-OS No. 1,768,933 describe, inter alia, nitrogen-containing boric acid esters as components for the manufacture of brake fluids.

DE-OS Pat. No. 2,350,569 relates to a hydraulic agent essentially consisting of a polyalkylene glycol, a monoalkyl polyalkylene glycol ether and 5 to 30% by weight of an alkyl polyethylene glycol tert.butyl ether.

U.S. Pat. No. 3,598,757 describes cyclic, nitrogen-containing boric esters as stabilizer for thermoplasts and U.S. Pat. Nos. 2,989,467; 2,989,468; 2,989,469 and 2,989,470 propose boric acid esters having a diol bridge as additives to lubricating oils.

In general, the known brake fluids on the basis of boric acid esters comply with the aforesaid basic requirements, but, as regards the other properties specified above, they are not fully satisfactory.

It is, therefore, the object of the present invention to provide a hydraulic fluid having, besides the aforesaid primary properties, a good lubricating effect, a high oxidation stability and a high acid stability and, consequently, a very good corrosion inhibiting behavior. It is a further object of the present invention to provide a hydraulic fluid the primary properties of which comply with the specifications DOT 3 as well as DOT 4.

The hydraulic fluid in accordance with the invention consists essentially of (A) About 10 to about 60% by weight of at least one nitrogen-containing boric acid ester of the following formulae I to III

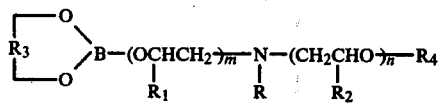

(I)

in which m and n each denotes an integer from 1 to 3, the sum of m and n being an integer from 2 to 6, and R denotes an alkyl group having from 1 to 9 carbon atoms, $R_1$ and $R_2$ denote hydrogen or methyl, $R_3$ denotes $—CH_2—CH_2—$ or $—CH_2CH_2OCH_2CH_2—$ and $R_4$ denotes hydrogen or a radical of the formula

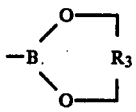

in which $R_3$ has the aforesaid meaning;

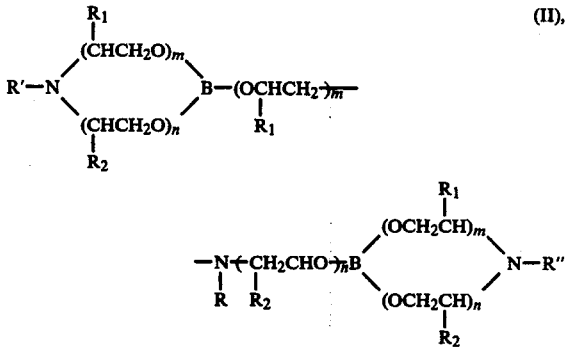

(II), in which m, n, R, $R_1$ and $R_2$ have the aforesaid meaning and R′ and R″ each has one of the meanings of R;

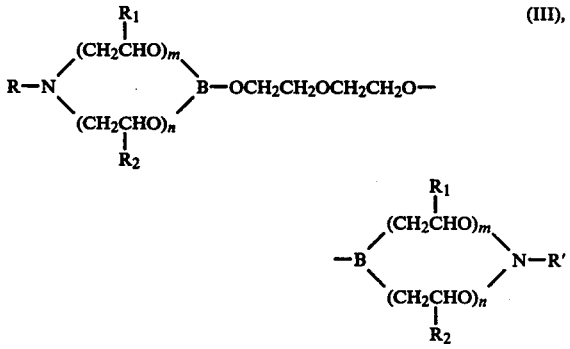

(III), in which m, n, R, R′, $R_1$ and $R_2$ have the aforesaid meaning;

(B) about 5 to about 30% by weight of an alkyl polyethylene glycol tert.butyl ether of the formula

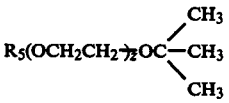

in which $R_5$ denotes alkyl having from 1 to 4 carbon atoms and z is an integer from 2 to 10, preferably from 2 to 5, and (C) about 35 to about 75% by weight of a glycol monoalkyl ether of the formula

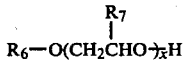

in which x denotes an integer from 2 to 5, $R_6$ denotes alkyl having from 1 to 4 carbon atoms and $R_7$ denotes hydrogen or methyl.

It has been surprising that the hydraulic fluid according to the invention possesses, on the one hand, a relatively high acid stability and oxidation stability (and, hence, a long lasting corrosion inhibiting effect) and, one the other, complies with the DOT 3 and DOT4 specifications, especially as regards the wet boiling point, dry boiling point and viscosity. Rather, it could have been expected that by the use of the compounds of formulae I, II and III (component A) a viscosity-temperature behavior complying with the requirements cannot be achieved. It is known (cf. DE-OS No. 2,532,228) that dialkyl amines such as dibutyl amine and dioctyl amine inhibit corrosion, but the use of larger amounts thereof to ensure a long lasting corrosion inhibition hitherto failed because of the negative effect on the viscosity or the boiling point of the brake fluid (considerable viscosity increase). The use of ethoxylated and/or propoxylated monoalkyl amines according to the invention and their incorporation into a boric acid glycol ester complex obviously eliminated the negative effect on the viscosity. Consequently, the hydraulic fluid according to the invention comprising components A, B and C complies with the manifold requirements and special demands on the use as brake fluid.

Preferred boric acid esters of formula I according to the invention are those in which m and n are 1 or 2 and the sum of m and n is in the range of from 2 to 4, R denotes linear or branched alkyl having from 3 to 9 carbon atoms, $R_1$ and $R_2$ denote hydrogen, $R_3$ is $—CH_2CH_2—$ and $R_4$ denotes hydrogen or a radical of the formula

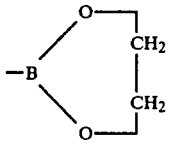

Preferred boric acid esters of formula II are those in which m and n are 1 or 2, the sum of m and n being in the range from 2 to 4, R, R' and R'' have the same meaning and each denotes liquor or branched alkyl having from 3 to 9 carbon atoms and $R_1$ and $R_2$ denote hydrogen.

Preferred boric acid esters of formula III are those in which m and n are 1 or 2, the sum of m and n being in the range of from 2 to 4, R and R' have the same meaning and each denotes linear or branched alkyl having from 3 to 9 carbon atoms and $R_1$ and $R_2$ denote hydrogen.

The boric acid esters to be used according to the invention are prepared by known methods. The boric acid ester of formula I is a reaction product of a two- to six-fold ethoxylated and/or propoxylated monoalkyl amine with 1 to 9 carbon atoms, orthoboric acid and ethylene glycol and/or diethylene glycol in a molar proportion of about 1:1:1 or 1:2:2. The ester of formula II is a reaction product of an amine as specified above and orthoboric acid in a molar proportion of about 3:2, while the ester of formula III is a reaction product of an amine of the aforesaid type, orthoboric acid and diethylene glycol in a molar proportion of about 2.2:1. To obtain the esters the respective components are reacted, while stirring at a temperature of from about 50° to about 150° C., preferably about 110° to about 140° C., in a reaction vessel provided with stirrer and optionally with reflux condenser, with continuous removal of the reaction water formed. The reaction is suitably carried out in the presence of an inert solvent forming an azeotropic mixture with water, such as, for example, benzene, toluene, xylene, ethyl benzene and the like.

To remove the reaction water it is likewise possible to perform the transesterification under reduced pressure, for example under a water jet vacuum (7 to 20 mbar). For obtaining better reaction conditions, for example for a better stirring of the content of the flask, it may be advantageous to use an inert diluent, preferably the alkyl polyethylene glycol tert.butyl ether contained in the hydraulic fluid or a partial amount thereof.

To produce the compounds of formula I it proved advantageous to proceed in two stages, i.e. to react in the first stage ethylene glycol (1,2-dihydroxy ethane) and/or diethylene glycol (2,2'-dihydroxy diethyl ether) with orthoboric acid and to react the product obtained with the amine in a second stage. Also the manufacture of compounds of formula III is suitably carried out in two stages. In the first stage, the amine is reacted with orthoboric acid and the product obtained is then reacted in the second stage with diethylene glycol.

When the reaction with continual water removal to obtain compounds I, II and III is complete, the solvent used, if any, is separated from the reaction product by a usual distillation and, if a further purification is indicated, the reaction product is stripped under reduced pressure (about 7 to 20 mbar), suitably at a temperature of about 90° to 150° C.

Suitable amines for the synthesis of the boric acid esters of formulae I, II, and III are those of the formula

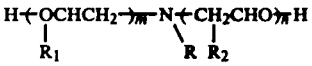

in which m, n, R, $R_1$ and $R_2$ have the above meaning. They are obtained in known manner by first introducing one mol of an amine of the formula $R—NH_2$ in which R has the indicated meaning, into an autoclave provided with stirrer and gas inlet, optionally together with an alkaline catalyst, preferably caustic soda or sodium methylate, heating to 100° to 160° C., preferably 110° to 130° C., and adding at that temperature the corresponding molar amount of ethylene oxide and/or propylene oxide, while stirring, the pressure being in the range of from about 5 to 6 bar. The reaction between the primary amine and the oxalkylene manifests itself by fall of pressure. As soon as the pressure has substantially dropped, the reaction is almost complete. In general, stirring is continued for about 30 minutes to 1 hour at a temperature of 110° to 130° C.

While the reaction of the monoalkyl amine with 2 mols of ethylene oxide or propylene oxide or 1 mol of ethylene oxide and 1 mol of propylene oxide (m=1, n=1) is carried out preferably in the absence of an alkaline catalyst, it proved advantageous to add an alkaline catalyst to the reaction mixture when further molecules of ethylene oxide and/or propylene oxide (m=2 or 3 and n=2 or 3) are to be incorporated into the ester. The ethylene oxide and/or propylene oxide is suitably added slowly over a period of 30 minutes to 4 hours either continuously or in dosed quantities.

Especially suitable amines for the synthesis of the boric acid ester of formulae I, II and III are the following ethoxylated and propoxylated monoalkyl amines or mixtures thereof:

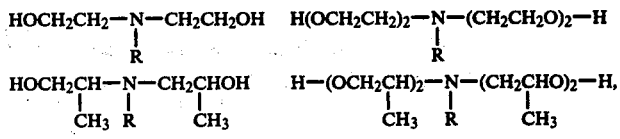

in which R denotes propyl, isopropyl, butyl, isobutyl, hexyl, isohexyl, octyl or isooctyl.

The hydraulic fluids according to the invention contain preferably from 20 to 40% by weight of boric acid esters of formulae I, II and III (component A), calculated on the total fluid, i.e. the sum of components A, B and C, and optionally further additives such as stabilizers or inhibitors.

The proportion of component B in the hydraulic fluids preferably ranges from 5 to 20% by weight, calculated on the total fluid. Alkyl polyethylene glycol tert.butyl ethers and their manufacture are described in DE-OS No. 2,350,569. The following compounds are preferred:

| | b.p. 760 mm Hg | Viscosity (mm²/sec) | | | setting point |
|---|---|---|---|---|---|
| | °C. | −40° C. | 37.8° C. | 98.9° C. | °C. |
| methyltriethylene glycol tert.butyl ether | 246 | 61 | 2.5 | 1.0 | −75 |
| methyltetraethylene glycol tert.butyl ether | 291 | 134 | 3.6 | 1.3 | −70 |
| methylpentaethylene glycol tert.butyl ether | 324 | — | 5.3 | 1.8 | −16 |
| ethyldiethylene glycol tert.butyl ether | 202 | 22 | 1.6 | 0.8 | −75 |
| ethyltriethylene glycol tert.butyl ether | 254 | 64 | 2.6 | 1.1 | −60 |
| n-propyldiethylene glycol tert.butyl ether | 218 | 24 | 1.7 | 0.9 | −75 |
| n-propyltriethylene glycol tert.butyl ether | 265 | 74 | 2.9 | 1.1 | −68 |
| n-propyltetraethylene glycol tert.butyl ether | 302 | 143 | 4.0 | 1.6 | −57 |
| iso-propyldiethylene glycol tert.butyl ether | 215 | 20 | 1.5 | — | −75 |
| n-butyldiethylene glycol tert.butyl ether | 236 | 57 | 2.1 | 1.0 | −75 |
| n-butyltriethylene glycol tert.butyl ether | 290 | 109 | 3.3 | 1.3 | −68 |
| iso-butyldiethylen glycol tert.butyl ether | 227 | 35 | 1.9 | 1.0 | −75 |
| iso-butyltriethylene glycol tert.butyl ether | 276 | 104 | 3.2 | 1.3 | −75 |

The proportion of component C, a polyglycol monoalkyl ether, in the hydraulic fluid of the invention preferably amounts to 50 to 69% by weight, calculated on the total fluid. Preferred representatives of this class of compounds, which are used either individually or in form of a mixture, are, for example, di-, tri- and tetraethylene glycol monomethyl, monoethyl, monopropyl, monobutyl and monoisobutyl ether, di-, tri- and tetrapropylene glycol monomethyl, monoethyl, monopropyl, monobutyl and monoisobutyl ether and corresponding oxalkylene glycol monoalkyl ethers simultaneously containing oxethylene and oxopropylene groups. Triethylene glycol monomethyl ether, tetraethylene glycol monomethyl ether, triethylene glycol monopropyl ether and triethylene glycol monobutyl ether, either individually or in the form of mixtures are especially preferred.

The polyglycol monoalkyl ethers of component C belong to the state of the art for a long time.

The hydraulic fluids according to the invention consisting of components A, B and C may contain further suitable additives in an amount of from 0.001 to 10% by weight, preferably 0.1 to 5% by weight, calculated on the total weight of the fluid. Known additives of this type are pH stabilizers and corrosion inhibitors, such as, for example, alkali metal carbonates, fatty acids, alkali metal salts of fatty acids, alkali metal phosphites and phosphates, phosphoric acid esters having from 1 to 10 carbon atoms in the alcohol moiety; mono- and dialkyl amines and the salts thereof, for example hexyl amine, octyl amine, isononyl amine, oleyl amine, dipropyl amine and dibutyl amine; alkanol amines and the salts thereof, for example mono-, di- and tri-ethanol amine; cyclohexyl amine; morpholine derivatives, triazoles such as benzotriazole and siloxanes. pH Regulators and corrosion inhibitors are generally added in an amount of from 0.05 to 5% by weight, calculated on the total fluid.

Further suitable additives are known antioxidants, preferably phenolic compounds such as phenyl-α-naphthyl amine, phenyl-β-naphthyl amine; phenothiazine and derivatives thereof; substituted phenols, for example dibutyl cresol, 2,6-dibutyl-p-cresol, 2,6-di-tert-.butyl-p-cresol, 2,4-dimethyl-6-tert.butyl phenol; quinones such as anthraquinone and hydroquinone; pyrocatechin and alkali metal nitriles. In general, the antioxidants are added in an amount of from 0.001 to 1% by weight, calculated on the weight of the total fluid.

Optionally further commonly used and suitable additives can be added.

It is obvious that the sum of the percentages by weight of components A, B, C and optionally D (all additives, if any) should amount to 100%.

The hydraulic fluids according to the invention are prepared by simply mixing the components, for example in a vessel with stirrer, whereby a homogeneous mixture is obtained. In general, mixing is performed at atmospheric pressure and at room temperature (about 10° to about 30° C.) optionally also at elevated temperature (30° to 50° C.) while suitably moisture is excluded.

The following examples illustrate the invention.

Preparation of boric acid esters of formulae I, II and III

EXAMPLE 1

In a 2 liter, three-necked round flask provided with propeller stirrer 1 mol (106 g) of diethylene glycol ($HOCH_2CH_2OCH_2CH_2OH$) and 1 mol (62 g) of orthoboric acid are mixed and, while heating to about 120° C. and stirring, the reaction water formed (water of esterification) is distilled off. After removal of 2 mols of water (36 g), the reaction mixture containing the boric acid ester of the formula

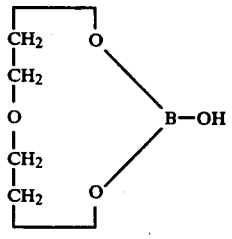

as intermediate product is allowed to cool, preferably while stirring, to about 50° to 80° C. Next, 1 mol (161 g) of an amine of the formula $$HOCH_2CH_2-\underset{\underset{CH_2CH_2CH_2CH_3}{|}}{N}-CH_2CH_2OH$$

are added, the reaction mixture is again heated to about 110° to 130° C. while stirring and the removal of the reaction water is continued. After removal of 1 mol (18 g) of water, the content of the flask containing the reaction product is stripped for about 10 to 30 minutes under a pressure of about 10 to 15 mbar (water jet vacuum) and at a temperature of about 120° to 150° C. A total amount of 266 g of boric acid ester (97% of the theory) are obtained in the form of a limpid yellow fluid having a viscosity of 2075 $mm^2$/sec at 20° C. The boric acid ester obtained has the formula

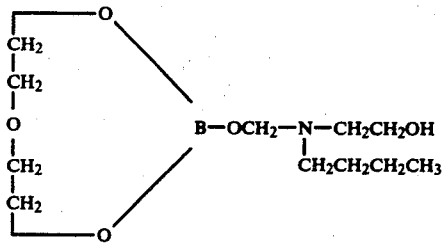

| Analysis: | % B | % N | % C | % H |
|---|---|---|---|---|
| calculated | 3.9 | 5.1 | 52.4 | 9.5 |
| found | 3.7 | 4.8 | 50.9 | 9.0 |

EXAMPLE 2

1 Mol (189 g) of amine of the formula $$HOCH_2CH_2-\underset{\underset{CH_2(CH_2)_4CH_3}{|}}{N}-CH_2CH_2OH,$$

1 Mol (62 g) of ethylene glycol ($HOCH_2CH_2OH$) and 100 ml (98 g) of methyltetraglycol tert.butyl ether are introduced into the three-necked round flask as described in Example 1 and the mixture is heated to 50° to 80° C. while stirring. At said temperature 1 mol (62 g) of orthoboric acid is slowly added over a period of about 15 to 50 minutes while stirring is continued. The mixture is heated to about 60° to 80° C. while stirring and 3 mols (54 g) of water are removed while stirring under a pressure of 9 to 12 mbar. 245 g (94.5% of the theory; after deduction of 98 g of methyltetraglycol tert.butyl ether) of boric acid ester are obtained. The product, a limpid, yellow fluid having the formula

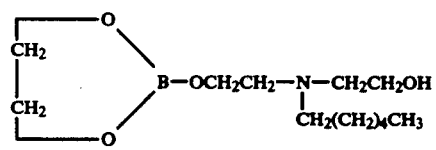

has a viscosity of 222 $mm^2$/sec at 20° C.

EXAMPLE 3

A 2 liter three-necked round flask provided with magnetic stirrer is charged with 2 mols (124 g) of ethylene glycol and 250 ml of toluene and the mixture is heated to 50° to 80° C. while stirring. At said temperature and while stirring is continued 2 mols (124 g) of orthoboric acid are added. By heating to reflux temperature (about 110° to 120° C.) and while stirring the reaction water formed is distilled off as azeotropic mixture with toluene. After removal of 4 mols (72 g) of water, the reaction mixture containing 2 mols of the boric acid ester of the formula

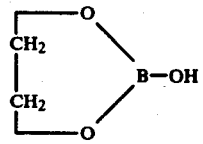

as intermediate product is allowed to cool, preferably while stirring, to a temperature below reflux, suitably to about 50° to 80° C. Next, 1 mol (161 g) of amine of the formula

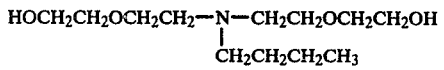

are added, the reaction mixture is heated again to reflux temperature (about 110° to 120° C.) while stirring and the water is removed as azeotrope. After removal of 2 mols (36 g) of water, the toluene is distilled off and the residue containing the reaction product is stripped for about 15 minutes in a water jet vacuum at 120° to 140° C. 289 g of boric acid ester (96% of the theory) are obtained in the form of a limpid, yellow fluid having a viscosity of 1275 $mm^2$/sec. The boric acid ester obtained has the formula

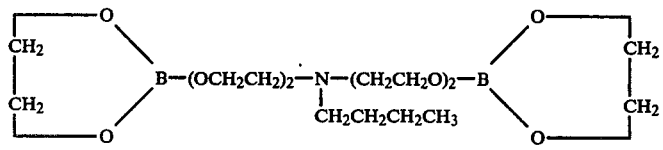

| Analysis: | % B | % N |
|---|---|---|
| calculated | 7.1 | 4.6 |
| found | 6.3 | 4.7 |

EXAMPLE 4

The reaction is carried out as described in Example 3 with the following modifications:

Instead of 2 mols of ethylene glycol there are used 1 mol (62 g) of ethylene glycol and 1 mol (106 g) of diethylene glycol and, instead of 250 ml toluene, 350 ml (343 g) of methyl-triethylene glycol tert.butyl ether are used. After addition of the orthoboric acid, 4 mols (72 g) of reaction water are removed while heating to about 110° to 140° C. and stirring under a vacuum of about 10 to 15 mbar. Further 2 mols of reaction water are removed in analogous manner in the second stage (amine addition). The reaction product obtained in an amount of 335 g (97% of the theory), after deduction of the amount by weight of methyl-triethylene glycol tert.butyl ether added, is a limpid, yellow fluid of the formula

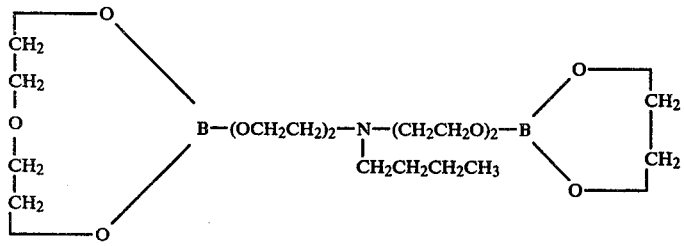

The reaction product in admixture with the methyl-triethylene glycol tert.butyl ether used as diluent, which need not be removed, for example by vacuum stripping, has a viscosity of 956 $mm^2$/sec at 20° C.

EXAMPLE 5

A two liter, three-necked round flask provided with stirrer is charged with 2 mols (294 g) of amine of the formula

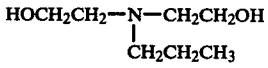

and 450 ml (441 g) of methyl-triethylene glycol tert.butyl ether and the mixture is heated to 50°–70° C. while stirring. At said temperature 2 mols (124 g) of orthoboric acid are added slowly, while stirring, over a period of about 30 to 60 minutes.

After the addition, stirring is continued while the temperature is raised to about 110° to 140° C. and the reaction water formed (4 mols or 72 g) is removed under a vaccum of about 10 to 15 mbar. The content of the flask containing 2 mols of boric acid ester of the formula

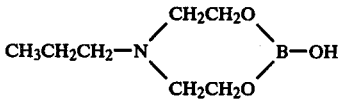

is allowed to cool to about 50° to 80° C. whereupon a further mol of the above amine is added while stirring and maintaining the temperature. The newly formed reaction water (2 mols or 36 g) is removed while heating again to 110° to 140° C. and stirring under a vacuum of about 10 to 15 mbar. The reaction mixture obtained is a limpid, yellow fluid having a viscosity of 89 $mm^2$/sec.

at 20° C. 437 g (95.5% of theory) of boric acid ester of the formula

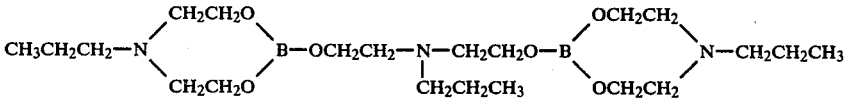

are obtained after deduction of the amount by weight of methyl-triethylene glycol tert.butyl ether used.

EXAMPLE 6

The reaction flask as used in Example 5 is charged with 3 mols (483 g) of amine of the formula

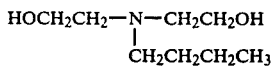

and heated to 50° to 80° C. while stirring. At said temperature 2 mols (124 g) of orthoboric acid are slowly added while stirring. After the addition, stirring is continued while heating to about 110° to 140° C. and the reaction water formed is removed (6 mols or 108 g) under a vacuum of about 10 to 15 mbar. 480 g (96.2% of the theory) of boric acid ester of the formula

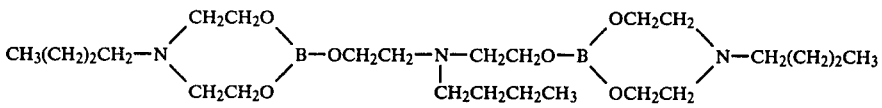

having a viscosity of 23,160 mm²/sec are obtained in the form of a limpid brown fluid.

EXAMPLE 7

A two liter, three-necked round flask provided with stirrer is charged with 2 mols (378 g) of amine of the formula

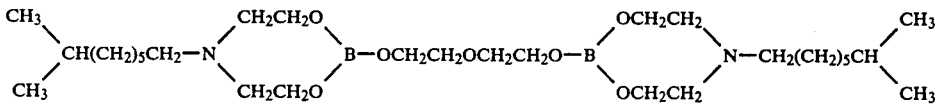

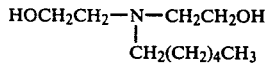

and 150 ml (147 g) of methyl-triethylene glycol tert.butyl ether and the mixture is heated to about 50° to 80° C. while stirring. At said temperature 2 mols (124 g) of orthoboric acid are added while stirring. Next, the mixture is heated to about 110° to 140° C. while stirring is continued and the reaction water formed is removed (2 mols or 36 g) under a vacuum of about 10 to 15 mbar. The content of the flask containing 2 mols of an intermediate product of the formula

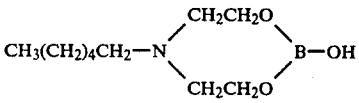

is allowed to cool to about 50° to 80° C., preferably while stirring. At said temperature 1 mol (106 g) of diethylene glycol is added while stirring. Further 2 mols (36 g) of reaction water are removed while heating again to about 120° to 140° C. and stirring under a vacuum of about 10 to 15 mbar. The reaction mixture obtained, a limpid, yellow fluid, has a viscosity of 287 mm²/sec at 20° C. After deduction of the methyl-triethylene glycol tert.butyl ether used as diluent, 529 g of boric acid ester of the formula

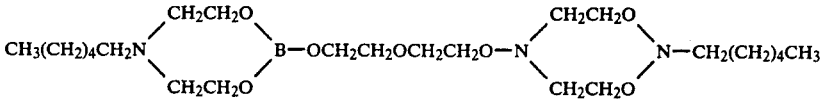

are obtained.

EXAMPLE 8

The reaction is carried out as described in Example 7 with the following modifications: 2 mols (462 g) of amine of the formula

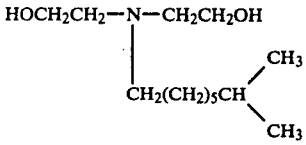

and 250 ml of toluene are first introduced into the flask.

After removal of a total amount of 4 mols (72 g) of reaction water, the reaction product is vacuum stripped under a pressure of about 10 to 15 mbar and at about 120° to 150° C., for about 30 to 60 minutes. 566 g (91% of the theory) of boric acid ester of the formula are obtained in the form of a limpid, light brown fluid having a viscosity of 9807 mm²/sec at 50° C.

Preparation of hydraulic fluids according to the invention

EXAMPLE 9

To prepare a hydraulic fluid according to the invention the following components are mixed:

| | |
|---|---|
| boric acid ester of Example 2 containing 71.4% b.w. of comp. A 28.5% b.w. of comp. C | 35% by weight |
| triethylene glycol monomethyl ether (component C) | 64.63% by weight |
| benzotriazole | 0.2% by weight |
| oleic acid | 0.1% by weight |
| monoisopropyl and diisopropyl phosphate (1:1) | 0.05% by weight |
| phenyl-α-naphthyl amine | 0.02% by weight |

EXAMPLE 10

A hydraulic fluid is prepared by mixing

| | |
|---|---|
| boric acid ester of Example 6 (comp. A) | 22% by weight |
| methyl-tetraglycol-tert.butyl ether (comp. B) | 10.6% by weight |
| triethylene glycol monomethyl ether (comp. C) | 67.03% by weight |
| benzotriazole | 0.2% by weight |
| oleic acid | 0.1% by weight |
| monoisopropyl and diisopropyl phosphate (1:1) | 0.05% by weight |
| phenyl-α-naphthyl aine | 0.02% by weight |

EXAMPLE 11

A hydraulic fluid is prepared by mixing

| | |
|---|---|
| boric acid ester of Example 7 containing 78.2% b.w. of comp. A 21.8% b.w. of comp. B | 34% by weight |
| triethylene glycol monomethyl ether (comp. C) | 65.63% by weight |
| benzotriazole | 0.2% by weight |
| oleic acid | 0.1% by weight |
| monoisopropyl and diisopropyl phosphate (1:1) | 0.05% by weight |
| phenyl-α-naphthyl amine | 0.02% by weight |

EXAMPLE 12

A hydraulic fluid is prepared from

| | |
|---|---|
| 5 boric acid ester of Example 4 containing 49.4% b.w. of comp. A 50.6% b.w. of comp. B | 31% by weight |
| triethylene glycol mono-methyl ether (component C) | 68.55% by weight |
| benzotriazole | 0.2% by weight |
| oleic acid | 0.1% by weight |
| monoisopropyl and diisopropyl phosphate (1:1) | 0.05% by weight |
| phenyl-α-naphthyl amine | 0.1% by weight |

EXAMPLE 13

A hydraulic fluid is prepared from

| | |
|---|---|
| boric acid ester of Example 5 containing 49.8% b.w. of comp. A 50.2% b.w. of comp. B | 42% by weight |
| triethylene glycol mono-methyl ether (component C) | 57.63% by weight |
| benzotriazole | 0.2% by weight |
| oleic acid | 0.1% by weight |

-continued

| | |
|---|---|
| monoisopropyl and diisopropyl phosphate (1:1) | 0.05% by weight |
| phenyl-α-naphthyl amine | 0.02% by weight |

COMPARATIVE EXAMPLE 1

A hydraulic fluid according to the state of the art is prepared from

| | |
|---|---|
| boric acid-ethylene glycol-triethylene glycol monomethyl ether 1 : 1 : 1 mol | 30% by weight |
| triethylene glycol monomethyl ether | 67.8% by weight |
| dibutyl amine | 2.0% by weight |
| bisphenol A | 0.2 % by weight |

COMPARATIVE EXAMPLE 2

A hydraulic fluid according to the state of the art is prepared from

| | |
|---|---|
| boric acid-diethylene glycol mono-methyl ether-diethanol amine ester 1 : 2 : 0.5 mols | 69.6% by weight |
| triethylene glycol monomethyl ether | 23.39% by weight |
| polyethylene glycol (m.w. 300) | 7.60% by weight |
| $NaNO_2$ | 0.01% by weight |

The hydraulic fluids according to Examples 9 to 13 of the invention and Comparative Examples 1 and 2 were tested by the following test regulations: reflux boiling point dry, reflux-boiling point wet and viscosity at −40° C. and 100° C. according to DOT 3 and DOT 4 regulations; pH, oxidation stability and corrosion according to SAE J 1703; acid stability by means of the KOH consumption indicating the reverse alkalinity; lubricating effect according to the Shell FBA (four ball apparatus) regulation.

The test results, which demonstrate the excellent properties of the hydraulic fluids according to the invention, are summarized in the following table.

As regards the reserve alkalinity of the fluid of comparative Example 1 it should be mentioned that by an increased addition of amine it could be adjusted to the values of the brake fluids according to the invention, resulting in an improved corrosion behavior, but this would involve a reduction of the boiling point below 200° C. and an increase of the viscosity at −40° C. to a value far above 2,000 $mm^2$/sec.

TABLE

| | hydraulic fluid according to | | | | | | | requirement according to specification |
|---|---|---|---|---|---|---|---|---|
| | Examples | | | | | Comparative Examples | | |
| Examination for | 9 | 10 | 11 | 12 | 13 | 1 | 2 | FMVSS 116 |
| boiling point according to FMVSS 116 (°C.) | 256 | 260 | 253 | 254 | 257 | 234 | 221 | min. 230 |
| wet boiling point according to FMVSS 116/DOT-4 (°C.) | 162 | 167 | 161 | 170 | 167 | 170 | 178 | min. 155 |
| viscosity ($mm^2$/sec) at −40° C. | 1800 | 1154 | 1247 | 1120 | 1195 | 1190 | 3285 | max. 1800 |
| 100° C. | 2.0 | 2.1 | 2.2 | 1.9 | 2.1 | 1.8 | 2.8 | min. 1.5 |
| pH according to SAE J 1703 | 8.8 | 9.2 | 9.1 | 8.7 | 9.3 | 8.1 | 8.5 | 7 to 11.5 |
| reserve alkalinity: consumption n/10 KOH (ml KOH/g) | 92.4 | 116 | 98.5 | 86.0 | 105.6 | 14.2 | 104 | — |
| oxidation stability according to FMVSS 116 ($mg/cm^2$) aluminum | −0.002 | +0.007 | +0.003 | 0 | 0 | +0.02 | +0.03 | <0.05 |
| cast iron | +0.002 | 0 | 0 | 0 | −0.002 | +0.01 | +0.01 | <0.3 |
| corrosion according to SAE J 1703 and JSO/DIS 4925 ($mg/cm^2$) 5 days | | | | | | | | |

TABLE-continued

| Examination for | hydraulic fluid according to Examples 9 | 10 | 11 | 12 | 13 | Comparative Examples 1 | 2 | requirement according to specification FMVSS 116 |
|---|---|---|---|---|---|---|---|---|
| 100° C. Sn | −0.02 | 0 | 0 | 0 | +0.02 | −0.06 | −0.21 | ±0.2 |
| steel | 0 | 0 | 0 | 0 | 0 | −0.49 | −0.13 | ±0.2 |
| Al | 0 | 0 | 0 | 0 | 0 | 0 | 0 | ±0.1 |
| cast iron | +0.03 | +0.04 | +0.03 | +0.02 | +0.04 | −0.31 | +0.13 | ±0.2 |
| brass | 0 | 0 | 0 | −0.01 | 0 | −0.03 | −0.05 | ±0.4 |
| copper | 0 | 0 | −0.07 | −0.01 | 0 | 0 | −0.03 | ±0.4 |
| zinc | +0.05 | +0.05 | +0.06 | +0.08 | +0.05 | +0.19 | +0.16 | ±0.4 |
| lubrication behavior on VKA: 1 hour, 40 bar (mm calotte diameter) | 0.70 | 0.80 | 0.75 | 0.80 | 0.75 | 1.25 | 1.90 | — |

What is claimed is:

1. Hydraulic fluid essentially consisting of (A) about 10 to about 60% by weight of at least one nitrogen-containing boric acid ester of the following formulae I to III

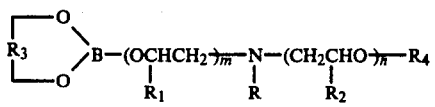

(I)

in which m and n each denotes an integer from 1 to 3, R denotes an alkyl group having from 1 to 9 carbon atoms, $R_1$ and $R_2$ denote hydrogen or methyl, $R_3$ denotes $—CH_2—CH_2—$ or $—CH_2CH_2OCH_2CH_2—$ and $R_4$ denotes hydrogen or a radical of the formula

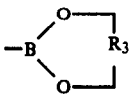

(II), in which $R_3$ has the aforesaid meaning;

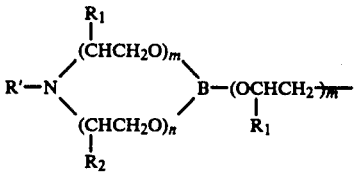

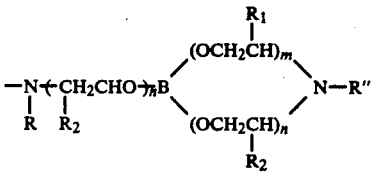

in which m, n, R, $R_1$ and $R_2$ have the aforesaid meaning and R′ and R″ each has one of the meanings of R;

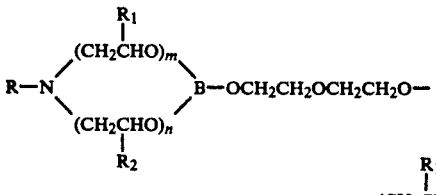

(III),

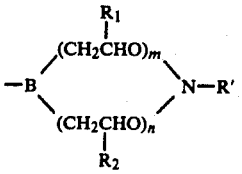

in which m, n, R, R′, $R_1$ and $R_2$ have the aforesaid meaning;

(B) about 5 to about 30% by weight of an alkyl polyethylene glycol tert.butyl ether of the formula

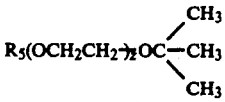

in which $R_5$ denotes alkyl having from 1 to 4 carbon atoms and z is an integer from 2 to 10, and (C) about 35 to about 75% by weight of a glycol monoalkyl ether of the formula

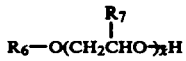

in which x denotes an integer from 2 to 5, $R_6$ denotes alkyl having from 1 to 4 carbon atoms and $R_7$ denotes hydrogen or methyl.

2. Hydraulic fluid as claimed in claim 1, wherein component A is a boric acid ester of formula I in which m and n denote 1 or 2, R denotes alkyl having from 3 to 9 carbon atoms, $R_1$ and $R_2$ denote hydrogen, $R_3$ denotes $—CH_2CH_2—$ and $R_4$ is hydrogen or

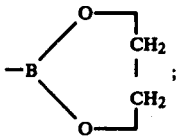

; or a boric acid ester of formula II in which m and n are 1 or 2, R, R′ and R″ are identical and each denotes alkyl having from 3 to 9 carbon atoms and $R_1$ and $R_2$ are hydrogen; component B is an alkyl polyethylene glycol tert.butyl ether of the defined formula in which z is an integer from 2 to 5; and component C is a glycol monoalkyl ether of the indicated formula in which x is 3 or 4.

3. Hydraulic fluid as claimed in claim 1, consisting of 20 to 40% by weight of component A, 5 to 20% by weight of component B and 50 to 69% by weight of component C.

4. Hydraulic fluid as claimed in claim 1, additionally containing 0.001 to 10% by weight of additives as component D.

* * * * *